US005199336A

United States Patent [19]

Wuilmart

[11] Patent Number: 5,199,336

[45] Date of Patent: Apr. 6, 1993

[54] TURN-COUNTING SETTING SCREWDRIVER

[76] Inventor: Albert Wuilmart, Outre-Cour 101, B-4651 Herve, Belgium

[21] Appl. No.: 803,594

[22] Filed: Dec. 9, 1991

[30] Foreign Application Priority Data

Dec. 7, 1990 [BE] Belgium ..... 09001169

[51] Int. Cl.[5] ..... B25B 15/00

[52] U.S. Cl. ..... 81/436; 81/DIG. 5

[58] Field of Search ..... 81/436, DIG. 5

[56] References Cited

U.S. PATENT DOCUMENTS 2,339,210 1/1944 Volz ..... 81/DIG. 5 X 2,421,310 5/1947 Berlincourt ..... 81/DIG. 5 X 2,817,985 12/1957 Capelle ..... 81/436

*Primary Examiner*—James G. Smith

*Attorney, Agent, or Firm*—Herbert Dubno

[57] ABSTRACT

A turn-counting setting screwdriver, on the stem of the blade of which there is movably mounted a tubular part which can move in the recess in the handle accommodating the stem of the blade. The handle is graduated over its periphery at the inlet to the recess and the movable part bears double graduations over at least part of its length, each graduation extending in the opposite direction relative to the other.

4 Claims, 1 Drawing Sheet

TURN-COUNTING SETTING SCREWDRIVER

FIELD OF THE INVENTION

The present invention relates to the mechanical or electronic adjustments required for initial settings according to technical instructions and more particularly, relates to a setting screwdriver enabling these adjustments to be carried out.

OBJECT OF THE INVENTION

The aim of the invention is, for example, to measure the setting of a screw in a very precise manner before dismantling and repositioning the said screw exactly on reassembly.

SUMMARY OF THE INVENTION

In order to achieve this object, the invention provides a turn-counting setting, it appeared advantageous to provide a turn-counting setting screwdriver provided with a blade crimped into the handle, wherein there is movably mounted on the stem of the blade a tubular part which can move in a recess in the handle holding the blade stem, the handle being graduated over its periphery at the inlet to the recess and the movable part bearing a double graduation over at least part of its length, each graduation extending in a direction opposite to the other.

BRIEF DESCRIPTION OF THE DRAWING

In order to enable the invention to be better understood it will now be described in further detail on the basis of the attached drawing, solely by way of example. In the drawing.

SPECIFIC DESCRIPTION

Figure 1:
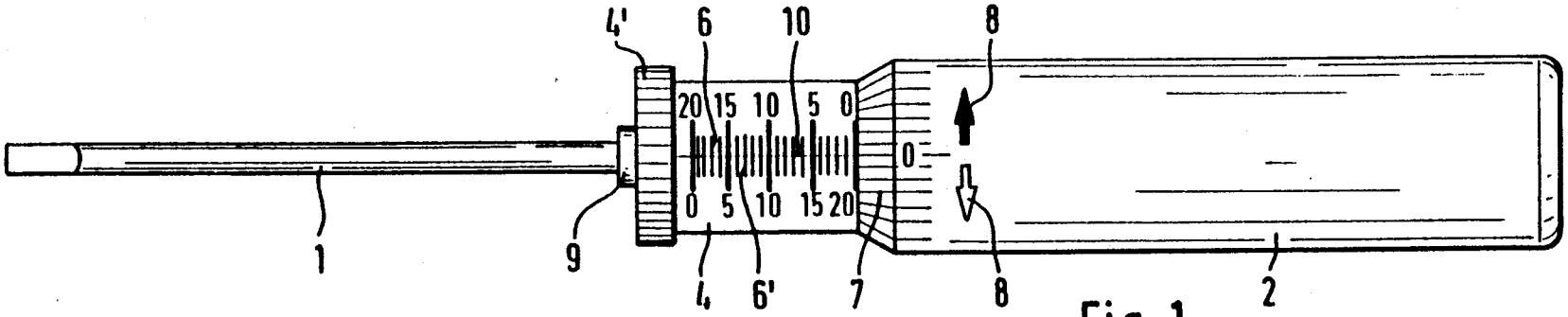
FIG. 1 is a plan view of a setting screwdriver according to the invention.
Figure 2:
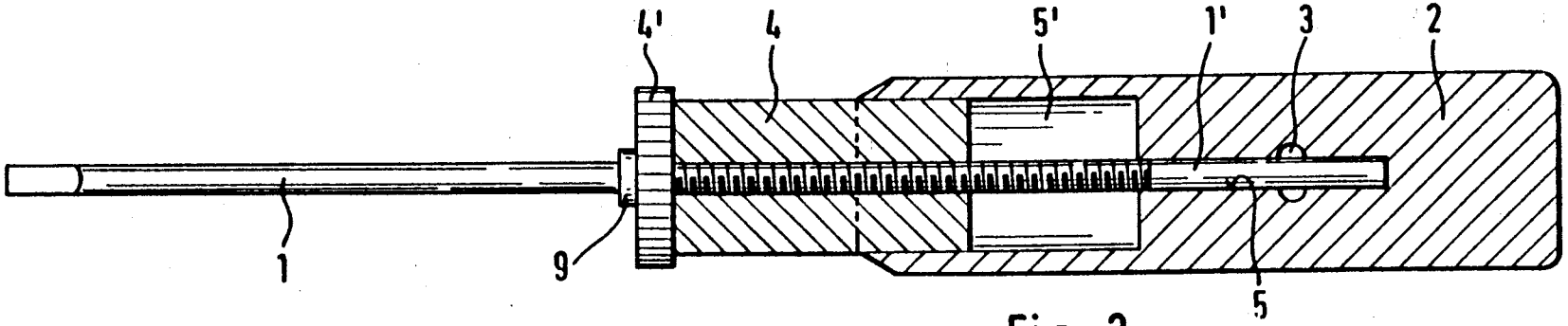
FIG. 2 is a longitudinal section through the setting screwdriver in FIG. 1.

In addition to the blade 1 and the handle 2, in which the stem 1' of the blade 1 is crimped (i.e. anchored) at 3, a turn-counting setting screwdriver produced in accordance with the invention comprises a tubular part 4 which is movably mounted on the blade 1 and is inserted at least partially in the widened front section 5' of the recess 5 provided in the handle 2 for the stem 1' of the blade 1.

The movable part 4 has an internal thread such that it can move on the stem 1' of the blade 1 which is also threaded and it is provided longitudinally with a double graduation 6, 6', each graduation extending in an opposite direction relative to the other.

The drawing shows a double graduation from 0 to 20 and each mark corresponds to one complete turn of the handle 2 and of the blade 1 respectively. This here corresponds to a possible setting of a maximum 20 turns.

For its part, the handle 2 bears on its periphery at the inlet to the recess 5' a graduation 7 which divides the said periphery into thirty-two equal sections, the marks ¼, ½, ¾ appearing according to the two possible directions of rotation. A ¾ mark corresponds to each ¼ mark and vice versa, the marks having different colors and the directions of rotation being indicated by the arrows 8, 8' of the corresponding color.

The blade 1 is provided with a sliding end-of-travel stop 9 for the movable part 4 at the opposite end to the handle 2. This stop 9 can be moved on the blade 1 which has a flat section on which there is tightened a screw for locking the stop in order to hold the latter in the desired location. For its part, the base of the widened section 5' of the recess 5 serves as an end-of-travel stop for the moving part 4 as it moves at the opposite end to the blade 1.

A turn-counting setting screwdriver according to the invention is simple, rapid and efficient to use. During each operation requiring a set screw either to be tightened or loosened, it is important to unscrew or screw-up, respectively, completely the graduated movable part 4 ensuring that the instrument is zeroed correctly, i.e. to ensure that the marking line 10 on the movable part 4 is opposite the 0 mark on the handle 2, while the part 4 is at the end of its travel, on the left or righthand side in the drawing.

In order to measure a setting, the graduated movable part 4 must be unscrewed, as indicated above, the part 4 held by one hand at its knurled section 4' and the setscrew (not illustrated) tightened completely by turning the handle 2 of the screwdriver towards the right-hand side with the other hand. The reading then taken on the moving part 4 provides the number of complete turns and the reading on the graduation on the handle provides the fraction of a turn to be added, the sliding stop 9 having in this case to be located at the end of its travel, on the lefthand side in the drawing.

If the removed setscrew has to be reassembled at the same setting, it merely has to be screwed up again completely and then slackened until the graduated movable part 4 is at the end of its travel and it will then be in its initial position.

For an initial adjustment, with the setscrew screwed up completely and the graduated movable part 4 completely unscrewed, as indicated above—the sliding stop 9 having to be located at the end of its travel, on the lefthand side in the drawing—it is sufficient to screw up the part 4 again by the number of turns, and possibly by a fraction of a turn, corresponding to the indications in the technical documentation, for the adjustment to be made, to hold the knurled section 4' with one hand and to unscrew the set screw by turning the handle 2 with the other hand in the direction of the arrow 8' until the stop 9 is in contact with the movable part 4.

When the same adjustment has to be made repeatedly, the graduated movable part 4 is screwed up completely and unscrewed by the number of turns and possibly by a fraction of a turn corresponding to the setting required and the sliding stop 9 is moved until it is in contact with the said part 4.

The adjustment may then be made as follows:

1. The part 4 is screwed up completely and the set screw screwed up completely.

2. With the blade of the screwdriver engaged in the screw, the knurled section 4' of the part 4 is held with one hand and the set screw is unscrewed by turning the handle 2 with the other hand in the direction of the arrow 8' until the sliding stop 9 comes into contact with the part 4.

3. For a given setting, the moving part 4 is screwed up again and the operation described under points 1 and 2 repeated.

It will be appreciated that a turn-counting setting screwdriver according to the invention may be produced in various sizes and with various graduations.

I claim:

1. A turn-counting screwdriver, comprising:

a handle;

a screwdriver shaft anchored in said handle and formed with a screwthread, said shaft being provided with a blade remote from said handle for engagement with a screw to be turned, said handle being formed with a recess opening in a direction of said blade;

a tubular part having a screwthread threadedly engaging said screwthread of said shaft, at least partly accommodated in said recess and angularly and axially movable relative to said handle;

graduations along a periphery of said handle at a mouth of said recess and cooperating with an index on said tubular part for signalling a fraction of a rotation of the screwdriver shaft;

double graduations along at least a portion of a length of said tubular part with each double graduation having graduation indicia extending in opposite directions relative to one another for signalling numbers of rotations of said shaft; and an end-of-travel stop slidable on said shaft, adapted to be fixed thereto and engageable with said tubular part.

2. The turn-counting screwdriver defined in claim 1 wherein each mark of the double graduations corresponds to a complete revolution of the handle and the blade relative to said tubular part.

3. The turn-counting screwdriver defined in claim 1 wherein the graduations along the periphery of said handle are 32 in number in marks at each quarter of the graduation to signify quarter, half, three-quarter and full revolutions of the handle and the blade relative to said tubular part.

4. The turn-counting screwdriver defined in claim 1 wherein said recess has a widened part providing an end-of-travel stop for said tubular part opposite said stop slidable on said shaft.

* * * * *